US011331923B2

(12) United States Patent
Choy

(10) Patent No.: US 11,331,923 B2
(45) Date of Patent: May 17, 2022

(54) FLUIDIC CARTRIDGES

(71) Applicant: HEWLETT-PACKARD DEVELOPMENT COMPANY, L.P., Spring, TX (US)

(72) Inventor: Si-Lam Choy, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 5 days.

(21) Appl. No.: 16/493,071

(22) PCT Filed: Nov. 10, 2017

(86) PCT No.: PCT/US2017/061005
§ 371 (c)(1),
(2) Date: Sep. 11, 2019

(87) PCT Pub. No.: WO2019/094022
PCT Pub. Date: May 16, 2019

(65) Prior Publication Data
US 2021/0276338 A1 Sep. 9, 2021

(51) Int. Cl.
*B41J 2/175* (2006.01)

(52) U.S. Cl.
CPC ..... *B41J 2/17513* (2013.01); *B41J 2/1753* (2013.01)

(58) Field of Classification Search
CPC ..... B41J 2/17513; B41J 2/1753
USPC ..... 347/86
See application file for complete search history.

(56) References Cited

U.S. PATENT DOCUMENTS 4,812,859 A * 3/1989 Chan ..... B41J 2/14129 347/63
5,600,358 A 2/1997 Baldwin et al.
6,130,694 A 10/2000 Beatty
6,203,148 B1 * 3/2001 Kishida ..... B41J 2/17513 347/86
6,250,749 B1 6/2001 Merz et al.
6,296,354 B1 10/2001 Hashimoto
6,328,423 B1 12/2001 Wong et al.
7,267,431 B2 9/2007 Anderson et al.
7,399,064 B2 7/2008 Fowler et al.
7,445,323 B2 11/2008 Anderson et al.
8,070,274 B2 12/2011 Steinmeiz et al.
(Continued)

FOREIGN PATENT DOCUMENTS

AU 767266 B2 6/2001
CA 2409419 A1 11/2001
(Continued)

OTHER PUBLICATIONS

Printer Pen, Dec. 8, 2014, https://www.ippinka.com/blog/pen-printer/.

*Primary Examiner* — Kristal Feggins
*Assistant Examiner* — Alexander D Shenderov
(74) *Attorney, Agent, or Firm* — Fabian VanCott

(57) ABSTRACT

An assembly, in an example, may include at least one die, a substrate comprising at least one electrical trace, a lid coupled to a first side of the substrate to contain an amount of fluid between the substrate and lid, and an adhesive film coupled to a second side of the substrate to protect the at least one electrical trace wherein the lid further comprises a main chamber for each of at least two distinct fluids and an overflow chamber fluidically coupled to each of the main chambers via an overflow channel.

19 Claims, 5 Drawing Sheets

(56) References Cited

U.S. PATENT DOCUMENTS

| | | | | |
|---|---|---|---|---|
| 9,446,587 | B2 | 9/2016 | Chen et al. | |
| 2002/0097306 | A1* | 7/2002 | Deshmukh | B41J 2/17506 347/86 |
| 2003/0081647 | A1* | 5/2003 | Bretl | H05K 3/284 374/49 |
| 2003/0142180 | A1* | 7/2003 | Gonzales | B41J 2/17513 347/86 |
| 2007/0076083 | A1 | 4/2007 | Gray et al. | |
| 2016/0334351 | A1 | 11/2016 | Lu et al. | |
| 2017/0165969 | A1 | 6/2017 | Yokoyama et al. | |
| 2017/0173949 | A1 | 6/2017 | Campbell-Brown et al. | |

FOREIGN PATENT DOCUMENTS

| | | | |
|---|---|---|---|
| RU | 2243100 | C2 | 4/2004 |
| RU | 2251488 | C2 | 4/2004 |
| WO | 2009/123636 | A2 | 10/2009 |

* cited by examiner

FLUIDIC CARTRIDGES

BACKGROUND

Portable fluid delivery devices allow users to, for example, print documents at geographically distinct locations. This fluid delivery device may provide the user with the ability to draft text documents, for example, and present signature documents for signing on sight. Different printed projects may be realized and potentially built upon later if a printed version were provided to a consumer on sight as well. Other fluid delivery devices may further implement a microfluidic device within the portable fluid delivery device that can receive an analyte and analyze it for diagnosis or other analyzing functions. This device may also allow a user to engage in on-site analysis of an analyte for a customer.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
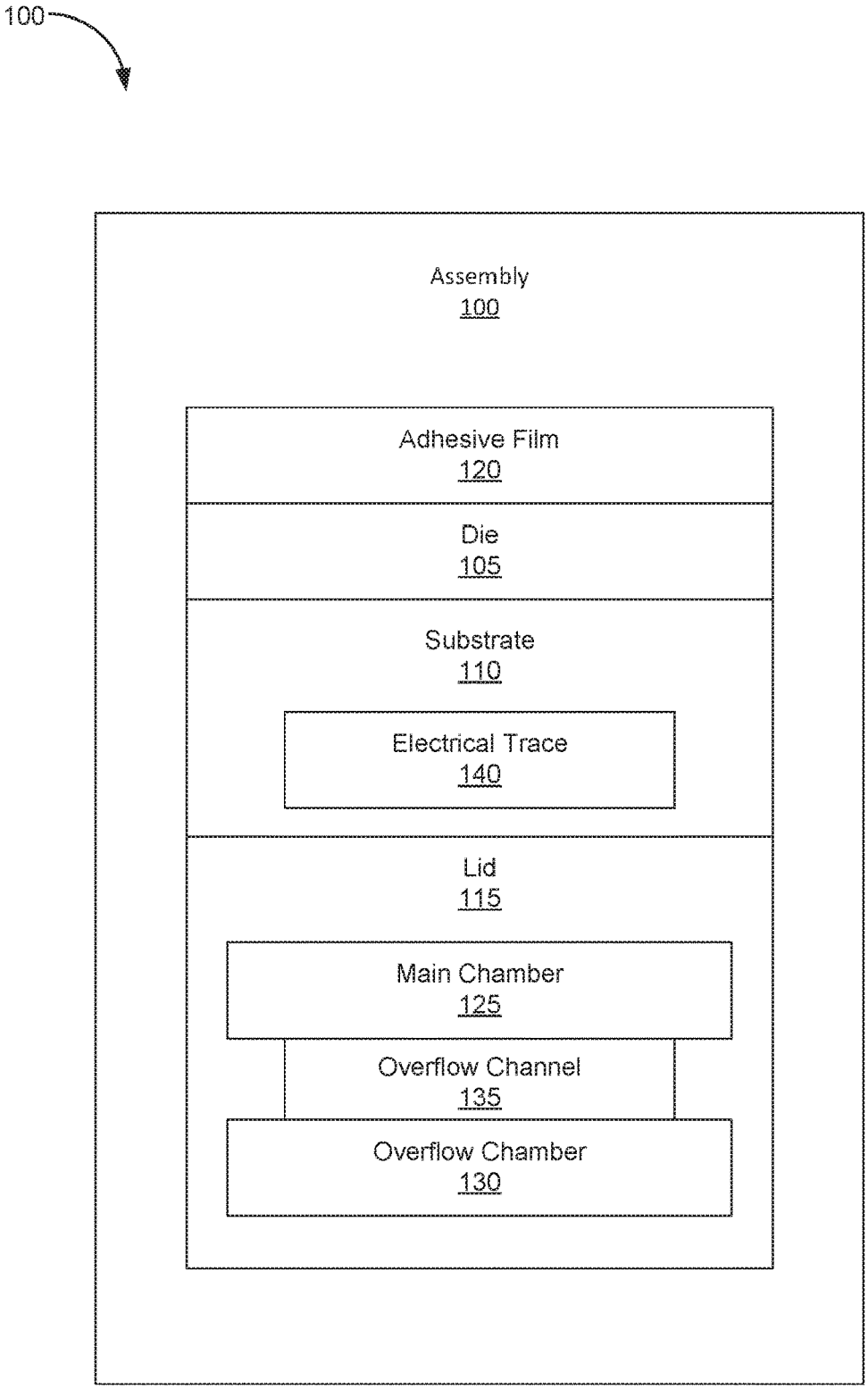
FIG. 1 is a bock diagram of an assembly according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description: however, the description is not limited to the examples and/or implementations provided in the drawings.

DETAILED DESCRIPTION

As discussed above, portable fluid delivery devices may, in some examples, allow a user to take the portable fluid delivery device wherever he or she travels in order to have access to the portable fluid delivery device at those geographically distinct locations. The user may, in real-time, alter documents for specific consumers and provide new draft versions of the document for immediate consumption by the customers. The user of the portable fluid delivery device may also be able to work and print at any location and still maintain access to a printer using the portable printing device.

In order to make the portable fluid delivery device relatively more portable, the portable fluid delivery device itself as well as its components may be made smaller. Smaller devices and elements of the portable fluid delivery device may also decrease the weight of the portable fluid delivery device adding to the quality of experience by a user.

One component that may be reduced in size is the fluidic delivery cartridge. The fluidic delivery cartridge is any device that can receive a fluid and pass the fluid from a reservoir to a die. The die may, in an example, eject the fluid therefrom using, for example, a piezoelectric or thermal device. In some examples, the fluid is not ejected from the die but, instead, the die retains the fluid for analysis, Thus, the present specification contemplates a fluidic delivery cartridge that may include, for example, a printing fluid cartridge, a microfluidic device used to analyze an analyte, or any other type of device within the portable fluid delivery device that can move an amount of fluid from a reservoir to a die.

The present specification describes an assembly that includes at least one die, a substrate comprising at least one electrical trace, a lid coupled to a first side of the substrate to contain an amount of fluid between the substrate and lid, and an adhesive film coupled to a second side of the substrate to protect the at least one electrical trace wherein the lid further comprises a main chamber for each of at least two distinct fluids and an overflow chamber fluidically coupled to each of the main chambers via an overflow channel.

The present specification also describes a fluidic cartridge that includes a substrate, the substrate comprising at least one die coupled to a first side of the substrate, wherein the at least one die is electrically coupled to a number of electrical interface pads via at least one electrical trace defined on a second side of the substrate, and a lid coupled to the second side of the substrate forming at least one fluid chamber between the lid and the substrate.

The present specification further describes a fluid delivery cartridge that includes at least one die to fluidically dispense at least two different colors of printing fluid, a substrate, wherein the at least one die is coupled to a first surface of the substrate, at least one electrical trace defined on the first surface of the substrate, the at least one electrical trace electrically coupling the at least one die to at least one electrical interface pad, and a lid coupled to a second surface of the substrate, the lid forming at least two main chambers to maintain the at least two different colors of printing fluid.

As used in the present specification and in the appended claims, the term "portable fluid delivery device" is meant to be understood broadly as any device that receives a fluidic delivery cartridge therein to either eject a fluid therefrom via the fluidic delivery cartridge or receive an analyte for analysis within the fluidic delivery cartridge.

As used in the present specification and in the appended claims the term "fluidic delivery cartridge" is meant to be understood as any selectively removable device that can be removed from the portable fluid delivery device and which receives a fluid for ejection therefrom or analysis therein. A fluidic delivery cartridge may also include an assembly or a fluidic cartridge.

Turning now to the figures, FIG. 1 is a bock diagram of an assembly (100) according to an example of the principles described herein. As described above, the assembly (100) may be used to receive an amount of fluid, maintain that amount of fluid in, for example, the main chamber (125), overflow channel (135), and/or overflow chamber (130) for use at the die (105). In an example, the fluid maintained within the assembly (100) is a printing fluid used for ejection onto a surface of a print media via the die (105). In an example, the fluid maintained within the assembly (100) is an analyte to be analyzed within the die (105). In an example, the fluid maintained within the assembly (100) is an analyte to be analyzed and/or manipulated within the die (105) and ejected from the assembly (100) into, for example, and assay plate. In an example, the fluid maintained within the assembly (100) is a chemical used during the analysis of an analyte be analyzed and/or manipulated within or offsite of the die (105) with the chemical being ejected from the assembly (100) into, for example, and assay plate. For ease of understanding, the examples described herein will be directed to an assembly (100) maintaining an amount of printing fluid for printing onto a surface of a print media. This description, however, is not meant to limit the use of the assembly (100) but instead it should be understood that the assembly (100) may be used as a microfluidic device that analyzes an analyte.

The assembly (100) includes a die (105), a substrate (110) into which the die (105) may be embedded, a lid (115), and an adhesive film (120) coupling the substrate (100) to the lid (115). The die (105) may be made of any layers of silicon may itself include any number of microfluidic channels used to transport the fluid from the main chamber (125) of the lid (115) at least throughout the die (105). In some examples, the die may include a number of microfluidic devices such as microfluidic pumps, thermal resistors, piezoelectric devices, and heating devices, among others. In an example, the die (105) may include a fluid actuating plate having at least one fluid actuation orifice defined therein. The fluid actuation orifice may be fluidically coupled to an ejection chamber used to eject an amount of fluid from the die (105).

The die (105) may be overmolded with, for example, epoxy mold compound (EMC) and coupled to the substrate (110). In an example, the die (105) may be embedded into the substrate (110) such that a top surface of the die (105) is flush with a top surface of the substrate (110).

The substrate (110) may be made of any resilient material that can be formed as described herein. In an example, the substrate (110) is made of a plastic. The substrate (110) may include a number of fluid fed slots defined therein in order to fluidically couple, at least, the main chamber (125) of the lid (115) to the die (105). In an example, the substrate (110) may include an overflow channel (135) defined therein fluidically coupling the main chamber (125) to an overflow chamber (130) also defined within the lid (115). The overflow channel (135) may, in an example, include a capillary pinch point. The capillary pinch point may hold an amount of fluid within the main chamber (125) thereby preventing the overflow chamber (130) from filling with fluid unless a certain level of change in temperature, change in pressure within the main chamber (125) and/or overflow chamber (130), and/or change in ambient pressure are experienced within the main chambers (125). In an example, the capillary pinch point may be used to ensure, upon initial fill of the main chamber (125) with liquid, that the overflow chambers (130) are initially empty of fluid. This ensures that a maximized available volume of fluid in the main chambers (125) can expand into the overflow chambers (130) due to any pressure change within the main chambers (125). During a print operation, for example, if there is no fluid in the overflow chambers (130), air may be bubbled into the main chambers (125) through the capillary pinch point (i.e., based on Laplace's law) as fluid is ejected out of the assembly (100).

The lid (115) may also be made of a resilient material such as plastic. The lid (115) may be formed to include a main chamber (125) and an overflow chamber (130). As mentioned above, the main chamber (125) may be fluidically coupled to the overflow chamber (130) via an overflow channel (135) defined in the substrate (110). In an example, the substrate (110) and lid (115) may be formed using an injection molding process or any other type of plastic formation process. The substrate (110) and lid (115) may be formed so as to fit together and hold an amount of fluid within, at least, the main chamber (125), overflow channel (135), and overflow chamber (130). In this example, a layer of adhesive may be applied between coupling surfaces of the lid (115) and substrate (110) to enable the seal. In an example, the substrate (110) and lid (115) may be coupled together using a welding process such as an ultrasonic welding process, a laser welding process, a solvent welding process, among other processes. In an example, the substrate (110) and lid (115) may include a gasket between them to seal the interface between the substrate (110) and lid (115).

The substrate (110) may include at least one electrical trace (140) defined on the surface of the substrate (110) opposite the surface where the lid (115) is coupled to the substrate (110). The electrical trace (140) may allow for the die (105) to be electrically and communicatively coupled to a processor of a portable fluid delivery device. The processor of the portable fluid delivery device may receive instructions from the portable fluid delivery device or a computing device communicatively coupled to the portable fluid delivery device that describes how the die (105) is to operate. In the example where the assembly (100) is a printing fluid cartridge, the processor of the portable fluid delivery device may move the assembly (100) across the surface of a print media while directing certain actuators within the die (105) to eject an amount of printing fluid from the orifices defined in a fluid actuating plate of the die (105). Similar examples exist where the assembly (100) is used to receive an analyte and process the analyte and/or eject the analyte into an assay plate. In either of these examples, the electrical traces may include any number of electrical traces (140) used to interface with the portable fluid delivery device. The electrical traces (140) may be coupled to a number of vias that electrically couple the electrical traces (140) with electrical traces (140) formed on an opposite side of the substrate (110). Additionally, the electrical traces (140) may be coupled to a number of electrical pads. The electrical pads may be formed on a surface of the substrate (110) such that the any number of electrical connectors of the portable fluid delivery device may be selectively coupled thereto.

The electrical traces (140) may be formed using, for example, laser direct structuring (LDS) processes. In this example, the substrate (110) may be formed out of thermoplastic material that has been doped with a metallic inorganic compound. The laser ablation of certain areas of the surface of the substrate (110) allow for deposition of metals during a metallization process.

To prevent damage to the electrical traces (140), an adhesive film (120) may be placed over the electrical traces (140). The adhesive film (120) may prevent fluids or other contaminants from touching the electrical traces (140) thereby preventing the damage to the assembly (100) and/or the portable fluid delivery device. The adhesive film (120) may have a number of cut-out portions that prevent the die (105), for example, from being covered by the adhesive film (120) such that the die (105) may eject an amount of fluid therefrom.

In an example, the overflow chamber (130) is fluidically coupled to atmosphere through a labyrinth structure formed on the surface of the lid (115) opposite the surface that is coupled to the substrate (110). The labyrinth may be any number of trenches etched into the surface of the lid (115) and may be fluidically coupled to each of the overflow chambers (130) formed within the lid (115). In an example, water vapor or any other type of vapor may be lost through a number of ports formed between the overflow chamber (130) and the labyrinth. A labyrinth coversheet may be place along a distance of the labyrinth so that the vapor may be retained in the labyrinth without leaking out of the assembly (100) and contaminating other parts of the assembly (100) and/or portable fluid delivery device.

Because of the design of the assembly (100), both the assembly (100) and the portable fluid delivery device may be relatively reduced in size in order to make the portable fluid delivery device more portable and user friendly. In an example, the thickness of the assembly (100) is between 8 and 12 mm. In an example, the thickness of the assembly (100) is 10 mm.

In an example, the assembly (100) may include any number of die (105) that provide any number of fluids to the die (105). Each of the fluids may be stored in a corresponding number of main chambers (125) with each of the main chambers (125) being fluidically coupled to its own overflow chamber (130) via an overflow channel (135). In the example where the assembly (100) is a printing fluid cartridge, the number of die (105) may be two with each of the die (105P) providing 1 or 2 different colors and/or types of printing fluid to the dies. Where the number of colors is 2, 2 main chambers (125) are formed in the lid (115). Where the number of colors is 4, 4 main chambers (125) are formed in the lid (115). In each example, however, each distinct fluid used in the assembly (100) is separated by at least one wall of a main chamber (125).

Each of the overflow channels (135) may include a capillary pinch point. The capillary pinch point accommodates for temperature changes within the assembly (100) and/or atmospheric pressure changes inside and/or outside of the assembly (100). For example, where air within any of the main chambers (125) expands, the fluid therein is allowed to break the capillary pinch point and flow into the respective overflow chambers (130). In some examples, as the fluid is passed into the overflow chambers (130), this may relieve pressure exerted within the firing chambers of the die (105) thereby maintaining the positive pressure at each orifice of the fluid actuation plate. The use of the capillary pinch points, overflow channel (135), and overflow chambers (130) may prevent drooling of the fluid out of the orifices of the fluid actuating plate. Depending on the contact angle of the fluid to orifice material, the surface tension of the fluid, and the diameter of the orifices, the orifices may support a limited positive pressure without drooling. For an orifice diameter of ~20 um, the hydrophilic nature of fluid actuating plate material (i.e., SU8), and fluid properties, the orifices may support ⅓ to ½ of an inch of water column pressure. Further, due to the volume of the main chamber (125) (i.e., ~0.7 cc), the overflow chamber (130) may be relatively small for a given temperature and altitude specification of, for example, 20-30% of the main chamber volume. Consequently, any one dimension of the overflow chamber (130) and its distance to the orifices may be limited such that the design of the assembly (100) stays within a ⅓ to ½-inch head height specification. Changes to the material properties of the fluid actuating plate material and orifice diameter can increase the allowable head height specification.

During operation, any fluid within the overflow chamber (130) may return to the main chamber (125) such that a meniscus may be once again formed at the capillary pinch point. In an example, the capillary pinch point may further include a pocket by the capillary pinch point and main chamber (125) interface that traps an amount of fluid therein to be used as a local reservoir for the capillary meniscus formed at the capillary pinch point.

The substrate (110) may also include a number of fluid fill ports that receive an initial amount of fluid into the assembled assembly (100). For each fluid fill port, a ball cork may be provided that plugs up the fluid fill ports once the fluid has been placed in each of the main chambers (125) within the assembly (100).

Figure 2:
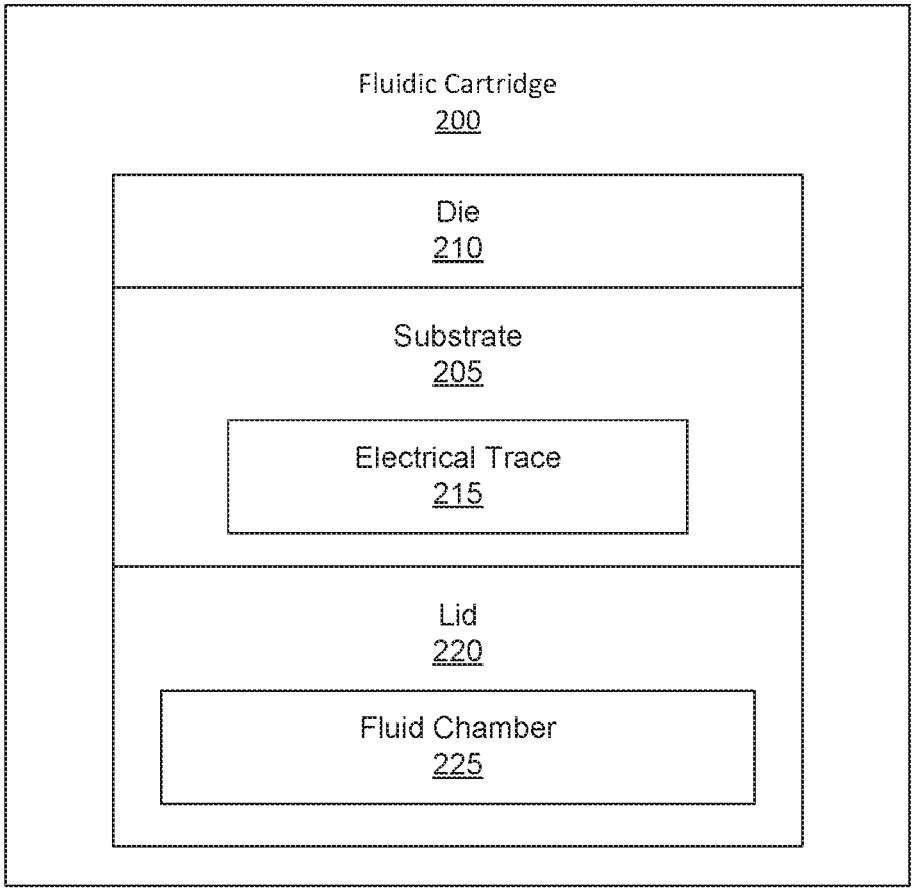
FIG. 2 is a block diagram of a fluidic cartridge according to an example of the principles described herein.

FIG. 2 is a block diagram of a fluidic cartridge (200) according to an example of the principles described herein. The fluidic cartridge (200) may include a substrate (205). The substrate (205) may include at least one die (210) coupled to a first side of the substrate (205). The substrate (205) may include at least one electrical trace (215) defined on a second surface of the substrate (205) opposite the first side and/or the first side of the substrate (205). The electrical trace (215) may electrically couple the die (210) to at least one electrical interface pad formed on the second side of the substrate (205).

The fluidic cartridge (200) may further include a lid (220) that is coupled to the second side of the substrate (205) forming at least one fluid chamber between the lid (220) and the substrate (205). Examples of the fluid chamber include the main chambers (FIG. 1, 125) as describe herein in connection with, at least, FIG. 1.

The fluidic cartridge (200) may also include an adhesive film applied over at least a portion of the first side of the substrate (205) to cover the at least one electrical trace (215). Adhesive materials may also be applied between the substrate (205) and the lid (220) to seal an amount of fluid in each of the fluid chambers (225) formed within the fluidic cartridge (200).

Similar to the assembly (FIG. 1, 100) described in connection with FIG. 1, the fluidic cartridge (200) may include any number of die (210), electrical traces (215), and fluid chambers (225), Additionally, the fluidic cartridge (200) may have, for each of the fluid chambers (225) an overflow chamber and an overflow channel fluidically coupling the fluid chambers (225) to each of their respective overflow chambers. Each of the overflow channels may include a capillary pinch point as described herein that accommodates for variances in pressure and/or temperature within the fluidic cartridge (200). The fluidic cartridge (200) may also include a number of fluid ports with ball corks that prevent fluid within the fluidic cartridge (200) from leaking out when the fluidic cartridge (200) is filled with fluid via the fluid ports.

The fluidic cartridge (200) may also include a labyrinth similar to that described in connection with FIG. 1. The labyrinth may fluidically couple each of the overflow chambers to atmosphere as described herein.

Figure 3:
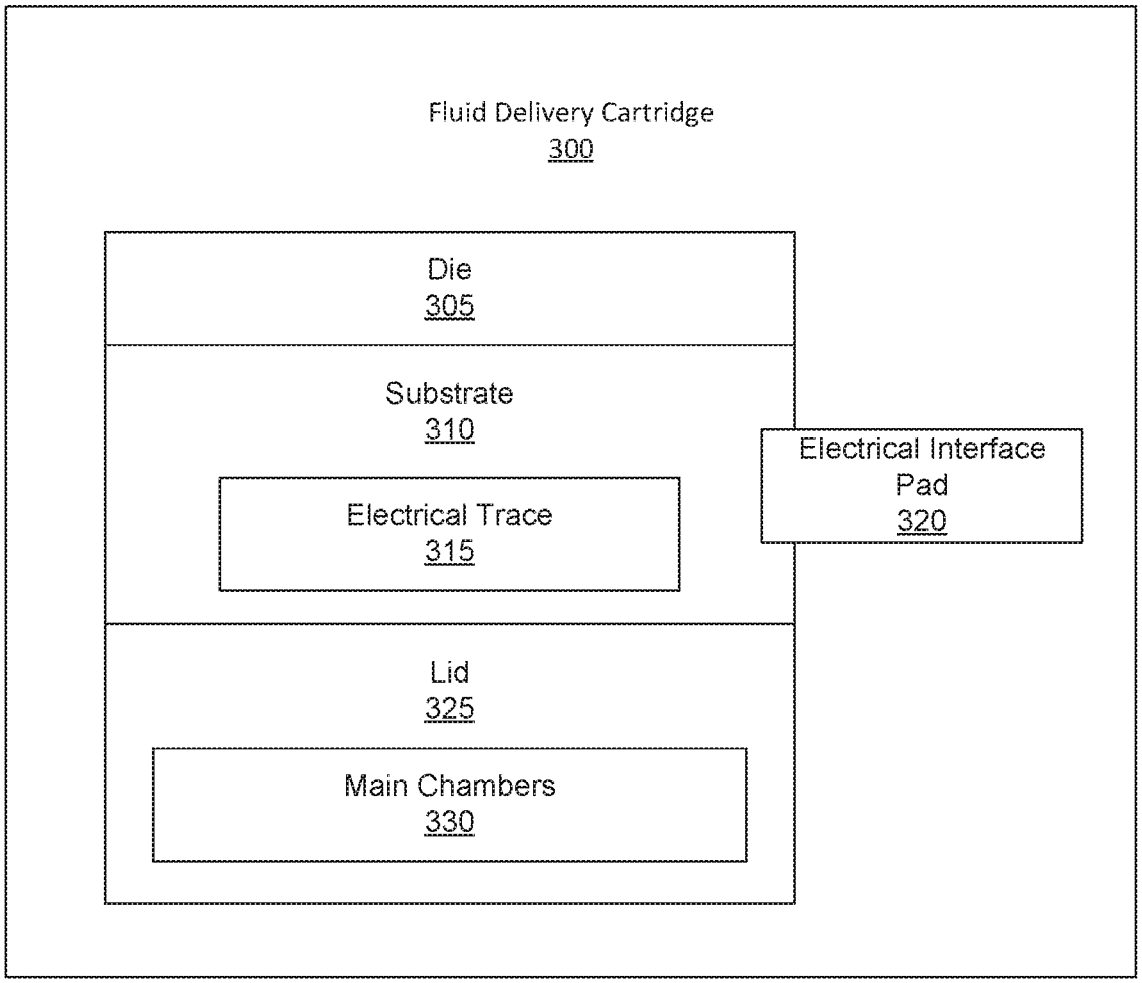
FIG. 3 is a block diagram of a fluid delivery cartridge according to an example of the principles described herein.

FIG. 3 is a block diagram of a fluid delivery cartridge (300) according to an example of the principles described herein. The fluid delivery cartridge (300) may include at least one die (305) coupled to a substrate (310). The substrate (310) may include a number of printing fluid slots that provide a path for printing fluid to flow to the die (305). Additionally, the substrate (310) may include at least one electrical trace (315) electrically coupling the die (305) to at least one electrical interface pad (320) defined on a surface of the substrate (310). The electrical interface pad (320) may allow the fluid delivery cartridge (300) to be selectively coupled to, for example, a portable fluid delivery device and to a processor of the portable fluid delivery device.

The fluid delivery cartridge (300) may further include a lid (325) that couples to a surface of the substrate (310) opposite the surface where the die (305) is coupled. The lid (325) may include at least one main chamber (330) to house a fluid for delivery to the die (305).

Similar to the assembly (FIG. 1, 100) described in connection with FIG. 1, the fluid delivery cartridge (300) may further include an overflow chamber fluidically coupled to the main chamber (330) via an overflow channel. The overflow channel may include a capillary pinch point that forms a meniscus in the overflow channel thereby restricting the amount of fluid that may overflow into the overflow chambers while still forming a way for fluid to move from the main chamber to the overflow chamber if pressure in the main chamber changes. The fluid delivery cartridge (300) may further include the labyrinth and fluid fill ports descried herein.

Figure 4:
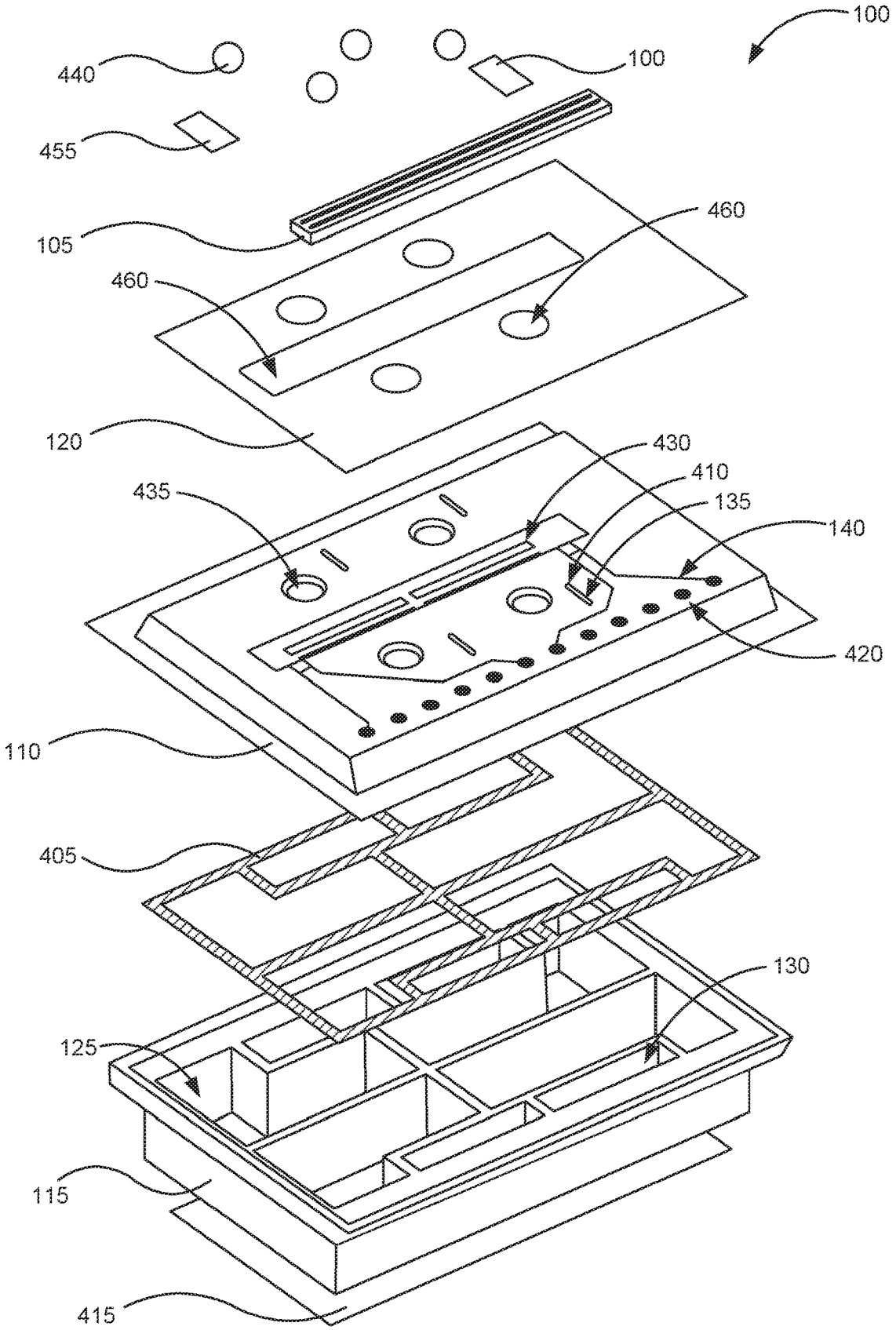
FIG. 4 is a perspective exploded view of the assembly of FIG. 1, according to an example of the principles described herein.

FIG. 4 is a perspective exploded view of the assembly (100) of FIG. 1, according to an example of the principles described herein. The assembly (100) includes the die (105) embedded or otherwise coupled to the substrate (110) using, for example, an adhesive. The die (105) may further include an amount of encapsulate (455) to cap a number of wire-bonds formed at the ends of the die (105).

The substrate (110) is coupled to the lid (115) using an adhesive (405) to make the main chambers (125) and overflow chambers (130) within the lid (115) maintain a fluid therein. Each of the main chambers (125) are fluidically coupled to their respective overflow chambers (130) via an overflow channel (135) formed into the substrate (110). Each of the overflow channels (135) include a capillary pinch point (410) that forms a meniscus as described herein in order to limit the amount of overflow fluid entering the overflow chambers (130). A labyrinth is formed on the side of the lid (115) opposite the side where the substrate (110) is coupled to the lid (115). The labyrinth is covered, at least partially, by a labyrinth coversheet (415).

The substrate (110) may include at least one electrical trace (140) formed into the surface opposite where the lid (115) is coupled to the substrate (110). The electrical traces (140), in the example shown in FIG. 4, may be electrically coupled to a via (420) that electrically couples the electrical traces (140) on one side of the substrate (110) to other electrical traces formed on a lip (455) extending out of the substrate (110) and the substrate (110)/lid (115) coupling. The lip (455) may include a number of electrical pads that are electrically coupled to the electrical traces (140) formed on the lip (455) of the substrate (110).

The substrate (110) may include a number of fluid feed slots (430) formed between the lid (115) and the substrate (110) to allow fluid to flow from each of the main chambers (125), through the fluid feed slots (430) and to the die (105). The number of main chambers (125) formed into the lid (115) may also indicate the number of individual fluid feed slots (430) formed in the substrate (110). This is done so as to maintain a separation between the distinct fluids maintained in each of the main chambers (125). The substrate (110) further includes at least one fluid fill port (435) into which the assembly (100) is filled with fluid. At least one ball cork (440) is placed within the fluid fill port (435) in order to keep the fluid within the assembly (100) after being filled with the distinct fluids.

The substrate (110) may also have an adhesive film (120) that covers the electrical traces (140) formed on the substrate (110). The adhesive film (120) prevents contaminants from contacting, at least, the electrical traces (140) that may cause electrical damage to the assembly (100) and/or a portable fluid delivery device the assembly (100) is coupled to. The adhesive film (120) may have a number of holes (460) defined therein to allow the die (105) and fluid feed ports (435) to be exposed through the adhesive film (120).

Figure 5:
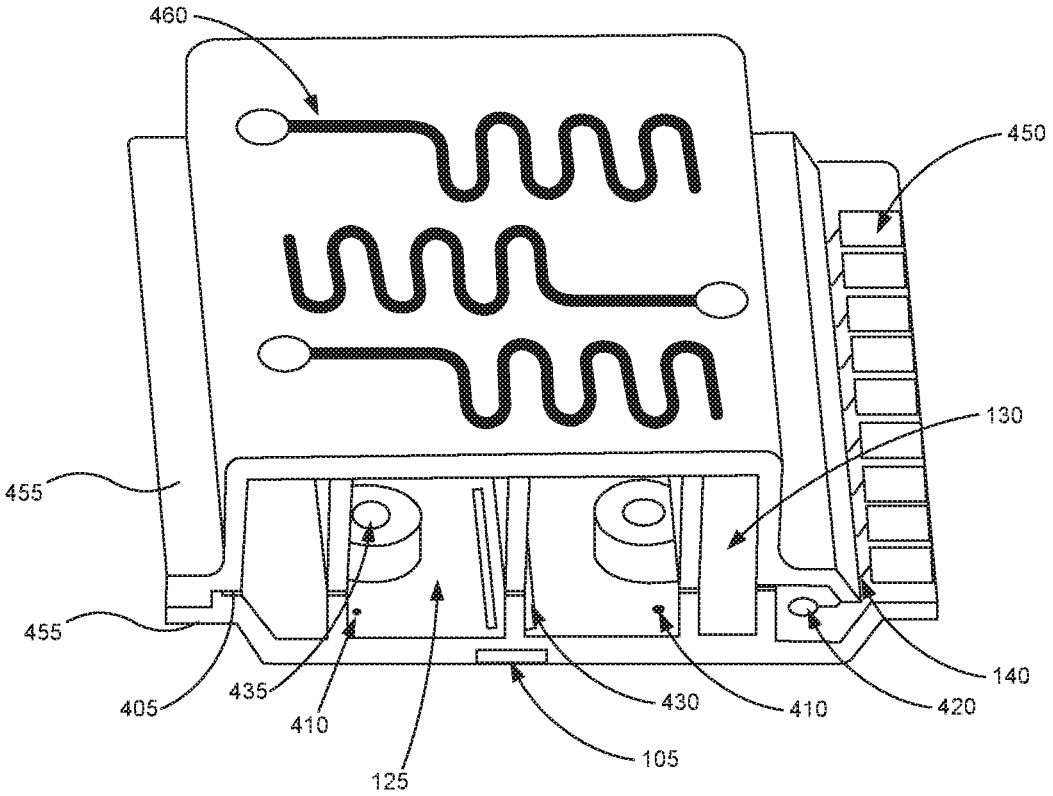
FIG. 5 is a perspective view of the assembly (100) shown in FIG. 4 assembled and turned right side up according to an example of the principles described herein.

FIG. 5 is a perspective view of the assembly (100) shown in FIG. 4 assembled and turned right side up according to an example of the principles described herein. The assembly (100) shown in FIG. 5 is "right side up" because the die (105) will be facing down towards the print media and in this shown orientation with the portable fluid delivery device.

The assembly (100) as shown now reveals the labyrinths (445) that are fluidically coupled to each of the overflow chambers (130). The labyrinths (445) vent each of the overflow chambers (130) to atmosphere allowing, in an example, some amount of vapor to escape. The vapor escaping may be maintained within, at least, a portion of the labyrinths (445) via the labyrinth coversheet (415), In an example, the labyrinth coversheet (415) allows the vapor to evaporate off instead of accumulating and dripping within the portable fluid delivery device.

The assembly (100) as shown now also reveals the lip (455) onto which the electrical pads (450) are formed. The electrical pads (450) are electrically coupled to the electrical traces (140) also formed on the same side of the substrate (110). The lip (455) with its electrical pads (450) and electrical traces (140) may interface with the portable fluid delivery device in order to receive signals and/or power from the portable fluid delivery device.

The specification and figures describe an assembly that includes a die with the assembly including a substrate and a lid where the lid includes a number of main chambers defined therein to house a number of distinct fluids. The substrate includes a number of electrical traces formed on the surface of the substrate opposite the lid. The resulting assembly as described provides for a relatively cheaper assembly with relatively fewer components used to form the assembly. Additionally, the assembly is relatively smaller allowing for the use of smaller portable fluid delivery devices. The height of the assembly as oriented in FIG. 5 is between 8 and 12 mm enabling the smaller profile portable fluid delivery device or any fluid delivery device. The parts of the assembly described herein may also be relatively easier to manufacture due to the size of the parts used.

The preceding description has been presented to illustrate and describe examples of the principles described. This description is not intended to be exhaustive or to limit these principles to any precise form disclosed. Many modifications and variations are possible in light of the above teaching.

What is claimed is:

1. An assembly comprising:

at least one die;

a substrate comprising at least one electrical trace;

a lid coupled to a first side of the substrate to contain an amount of fluid between the substrate and lid; and an adhesive film coupled to a second side of the substrate to protect the at least one electrical trace;

wherein the lid further comprises a main chamber for each of at least two distinct fluids and an overflow chamber fluidically coupled to each of the main chambers via an overflow channel; and wherein the overflow channel is defined through the substrate.

2. The assembly of claim 1, wherein the at least one die comprises two die with each die being provided with at least one distinct fluid.

3. The assembly of claim 2, wherein the distinct fluids are different colors of printing fluid and wherein the different colors of printing fluids are provided to the dies via fluidically separate channels defined between the substrate and the lid.

4. The assembly of claim 1, wherein the overflow channel further comprises a capillary pinch point to hold an amount of fluid within the main chamber.

5. The assembly of the claim 4, wherein the overflow chamber is vented to atmosphere thru a labyrinth structure defined on a surface of the lid opposite the substrate.

6. The assembly of claim 5, further comprising a seal layer to seal the labyrinth structure.

7. The assembly of claim 5, further comprising a labyrinth coversheet over the labyrinth to retain vapor.

8. The assembly of claim 1, further comprising at least one ball cork to plug at least one fluid port after the assembly is filled with fluid.

9. The assembly of claim 1, wherein a periphery of the lid is attached to a periphery of the substrate.

10. The assembly of claim 1, wherein the lid has a depth within which are interior dividing walls that define the main chambers and overflow chambers, the main chambers fluidically coupled to a respective one of the overflow chambers via an overflow channel that is defined in the substrate.

11. The assembly of claim 1, further comprising a gasket to seal a seam between the lid and substrate.

12. The assembly of claim 1, wherein the adhesive film has a number of cut-out portions through which the die ejects fluid.

13. A fluidic cartridge, comprising:

a substrate, the substrate comprising at least one die coupled to a first side of the substrate, wherein the at least one die is electrically coupled to a number of electrical interface pads via at least one electrical trace defined on a second side of the substrate; and a lid coupled to the second side of the substrate forming at least one fluid chamber between the lid and the substrate.

14. The fluidic cartridge of claim 13, further comprising an adhesive film applied over at least a portion of the first side of the substrate to cover the electrical traces.

15. The fluidic cartridge of claim 13, wherein the at least one die comprises two dies with each die being provided two distinct fluids.

16. The fluidic cartridge of claim 13, wherein the lid further comprises a fluidic chamber for each of at least two distinct fluids and an overflow chamber fluidically coupled to each of the fluidic chambers via an overflow channel.

17. A fluid delivery cartridge, comprising:

at least one die to fluidically dispense at least two different colors of printing fluid;

a substrate, wherein the at least one die is coupled to a first surface of the substrate;

at least one electrical trace defined on the first surface of the substrate, the at least one electrical trace electrically coupling the at least one die to at least one electrical interface pad; and a lid coupled to a second surface of the substrate, the lid forming at least two main chambers to maintain the at least two different colors of printing fluid.

18. The fluid delivery cartridge of claim 17, further comprising at least two overflow chambers each fluidically coupled to at least one of the two main chambers via an overflow channel.

19. The fluid delivery cartridge of claim 18, wherein the overflow channel further comprises a capillary pinch point to hold an amount of printing fluid within each of the main chambers.

* * * * *